US012654918B2

(12) United States Patent
Palumbo, Jr. et al.

(10) Patent No.: US 12,654,918 B2
(45) Date of Patent: Jun. 16, 2026

(54) LOCKABLE CONTAINER

(71) Applicant: ComboCup LLC, Lowellville, OH (US)

(72) Inventors: Roy Palumbo, Jr., Lowellville, OH (US); Albert M. Bleggi, Nales, FL (US); Louis A. O'Neill, Girard, OH (US)

(73) Assignee: COMBOCUP LLC, Lowellville, OH (US)

( * ) Notice: Subject to any disclaimer, the term of this patent is extended or adjusted under 35 U.S.C. 154(b) by 209 days.

(21) Appl. No.: 17/570,915

(22) Filed: Jan. 7, 2022

(65) Prior Publication Data

US 2023/0219728 A1 Jul. 13, 2023

(51) Int. Cl.
*B65D 55/14* (2006.01)
*B65D 47/12* (2006.01)

(52) U.S. Cl.
CPC ..... *B65D 55/145* (2013.01); *B65D 47/12* (2013.01); *B65D 2543/00046* (2013.01)

(58) Field of Classification Search
CPC ..... B65D 55/145; B65D 47/12; B65D 2543/00046; B65D 47/08; B65D 55/02; B65D 2543/00231; B65D 50/00; B65D 55/10; B65D 55/14; A47G 2400/123; A47G 2400/126; A61J 7/0445
USPC ..... 206/1.5; 220/210, 713, 254.1, 315, 220/254.4, 821, 253; 292/341.15; 70/158, 71; 215/207
See application file for complete search history.

(56) References Cited

U.S. PATENT DOCUMENTS

| | | | |
|---|---|---|---|
| 2,415,767 | A | 2/1947 | Shaw |
| 2,578,089 | A | 12/1951 | Piker |
| 2,595,113 | A | 4/1952 | Taberer |
| 3,093,238 | A | 6/1963 | King, III |
| 3,331,522 | A | 7/1967 | Bridges |
| 4,852,725 | A | 8/1989 | Folsom |
| 5,094,363 | A | 3/1992 | Monahan |
| 5,251,542 | A | 10/1993 | Itoh |
| D356,469 | S | 3/1995 | Musilli et al. |
| 5,427,265 | A | 6/1995 | Cautereels et al. |
| D364,320 | S | 11/1995 | Sipe |
| D376,979 | S | 12/1996 | Davidson, III |
| 5,590,801 | A | 1/1997 | Cohen |

(Continued)

FOREIGN PATENT DOCUMENTS

| | | | | |
|---|---|---|---|---|
| CN | 111994460 A | * | 11/2020 | ..... B65D 55/00 |
| WO | WO0214635 A1 | | 2/2002 | |

*Primary Examiner* — Don M Anderson
*Assistant Examiner* — John Martin Hoppmann
(74) *Attorney, Agent, or Firm* — Calfee, Halter & Griswold LLP

(57) ABSTRACT

A drinking device that includes a receptacle for holding a liquid, a cover removably attached to the receptacle to encapsulate the liquid within the receptacle, and a locking element. The cover has a drinking opening that allows a user to access the liquid within the receptacle. The locking element is attached to one of the cover or receptacle, and configured to engage the other of the cover or receptacle. The locking element is movable between one or more locking positions for securing the cover to the receptacle, where a first locking position of the locking element secures the cover to the receptacle and prevents a user from accessing liquid through the drinking opening.

15 Claims, 7 Drawing Sheets

(56) References Cited

U.S. PATENT DOCUMENTS

| | | | | |
|---|---|---|---|---|
| 5,598,792 | A | 2/1997 | Wales | |
| 6,003,718 | A | 12/1999 | Lu | |
| 7,866,505 | B2 | 1/2011 | Perlman et al. | |
| 8,938,999 | B2 | 1/2015 | Dahl | |
| 10,189,619 | B1 | 1/2019 | Crawley | |
| 10,872,482 | B1 | 12/2020 | Colton | |
| 11,116,697 | B1 * | 9/2021 | Williams | A61J 1/1418 |
| 11,124,340 | B2 | 9/2021 | Crawley | |
| 2005/0097931 | A1 | 5/2005 | Miller | |
| 2005/0161455 | A1 | 7/2005 | Studee | |
| 2005/0263411 | A1 | 12/2005 | Harrington | |
| 2006/0108364 | A1 | 5/2006 | Benktzon | |
| 2007/0228042 | A1 | 10/2007 | Yeager | |
| 2008/0048461 | A1 | 2/2008 | Jayasuriya et al. | |
| 2009/0078607 | A1 | 3/2009 | Ballard | |
| 2015/0272825 | A1 | 10/2015 | Lim | |
| 2018/0058812 | A1 | 3/2018 | Gilbert | |
| 2019/0248555 | A1 | 8/2019 | Cabouli | |
| 2019/0375554 | A1 * | 12/2019 | Hirst | B65D 35/46 |
| 2020/0156836 | A1 * | 5/2020 | Leary | A47G 19/22 |
| 2020/0352370 | A1 * | 11/2020 | Sims | B65D 43/0225 |
| 2021/0394981 | A1 * | 12/2021 | Warner | B65D 55/14 |

* cited by examiner

LOCKABLE CONTAINER

TECHNICAL FIELD

The present invention relates generally to containers for holding food and/or liquid, and more particularly, to lockable containers for preventing others from contacting the food and/or liquid in such devices.

BACKGROUND

People are becoming more knowledgeable regarding health matters and, more particularly, health matters in which diseases are spread via the sharing of germs between two or more people. Accordingly, measures are being taken to prevent the sharing of germs, including the sharing of germs through food and/or drinks.

SUMMARY

An exemplary embodiment of a drinking device includes a receptacle for holding a liquid, a cover removably attached to the receptacle to encapsulate the liquid within the receptacle, and a locking element attached to the receptacle. The cover has a drinking opening that allows a user to access the liquid with the receptacle. The locking element is movable between one or more locking positions for engaging the cover and securing the cover to the receptacle, where a first locking position secures the cover to the receptacle and prevents a user from accessing liquid through the drinking opening.

Another exemplary embodiment of a drinking device includes a receptacle for holding a liquid, a cover removably attached to the receptacle to encapsulate the liquid within the receptacle, and a locking element attached to the receptacle. The cover has a lower portion and an upper portion. The lower portion has a lower drinking opening and a lower locking opening, and the upper portion is rotatable relative to the lower portion and has an upper drinking opening and one or more locking receivers. The locking element is movable between one or more locking positions for securing the cover to the receptacle and an unlocked position. The locking element includes a combination portion that allows a user to enter a lock combination such that a user can move the locking element between the one or more locking positions and the unlocked position. The locking element is in a first locking position when the locking element extends through the lower locking opening of the lower portion of the cover and is secured within a first locking receiver of the upper portion of the cover. The lower drinking opening of the lower portion of the cover is not aligned with the upper drinking opening of the upper portion of the cover when the locking element is in the first locking position such that a user is prevented from accessing the liquid through the upper drinking opening.

Another exemplary embodiment of a drinking device includes a receptacle for holding a liquid, a cover removably attached to the receptacle to encapsulate the liquid within the receptacle, and a locking element attached to the cover. The cover has a drinking opening that allows a user to access the liquid within the receptacle. The locking element is movable between one or more locking positions for engaging the receptacle and securing the cover to the receptacle, where a first locking position secures the cover to the receptacle and prevents a user from accessing liquid through the drinking opening.

An exemplary embodiment of a lockable container includes a receptacle for holding a food or liquid, a cover removably attached to the receptacle to encapsulate the food or liquid within the receptacle, and a locking element attached to the receptacle. The locking element is movable between one or more locking positions for engaging the cover and securing the cover to the receptacle, where a first locking position secures the cover to the receptacle and prevents a user from accessing the food or liquid from the receptacle.

Another exemplary embodiment of a lockable container includes a receptacle for holding a food or liquid, a cover removably attached to the receptacle to encapsulate the food or liquid within the receptacle, and a locking element attached to the cover. The locking element is movable between one or more locking positions for engaging the receptacle and securing the cover to the receptacle, where a first locking position secures the cover to the receptacle and prevents a user from accessing the food or liquid from the receptacle.

DETAILED DESCRIPTION

The Detailed Description describes exemplary embodiments of the invention and is not intended to limit the scope of the claims in any way. Indeed, the invention is broader than and unlimited by the exemplary embodiments, and the terms used in the claims have their full ordinary meaning. Features and components of one exemplary embodiment may be incorporated into the other exemplary embodiments. Inventions within the scope of this application may include additional features, or may have less features, than those shown in the exemplary embodiments.

People often use containers for holding liquid and/or food (e.g., cups, coffee mugs, Thermos®, lunch containers, etc.) to bring food and/or drinks to a location that may be crowded with other people. For example, people may bring such containers to work, school, a park, and various other types of locations that can be crowded with people. The exemplary containers described herein include a locking element that allows a user to lock the container and block any openings of the container when it is not being used to prevent other people from contacting any contents within the container. In particular, the locking elements can be used to secure the container in a locked position that blocks a drinking opening and/or a eating opening, where the drinking and/or eating opening cannot be unlocked until the user engages the locking device to move the locking device to an unlocked position.

Figure 1:
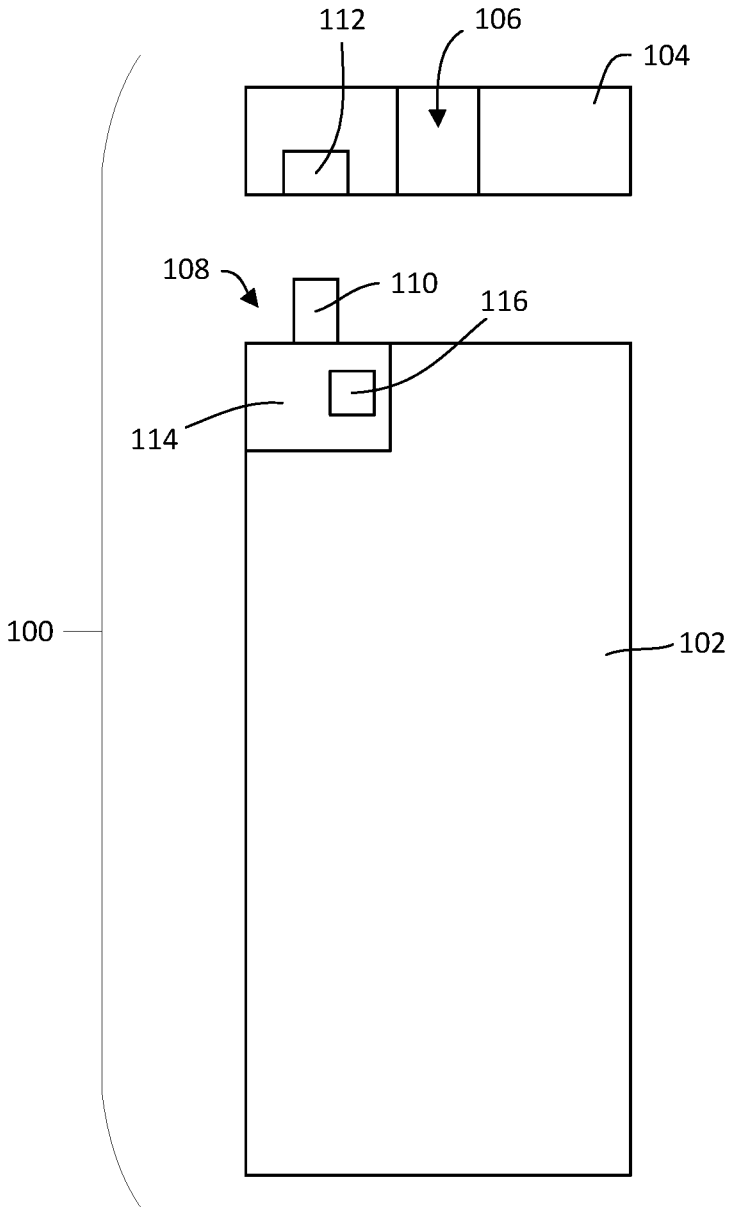
FIG. 1 is an exploded schematic view of an exemplary embodiment of a drinking device having a locking element.

Referring to FIG. 1, an exemplary embodiment of a drinking device 100 includes a receptacle 102 and a cover 104. The receptacle 102 is configured to hold a liquid, and the cover 104 is configured to be removably attached to the receptacle 102 to encapsulate the liquid within the receptacle 102. The cover 104 can be removably attached to the receptacle 102, for example, by a threaded connection, a snap-fit connection, a friction fit connection, or any other suitable type of connection allows the cover 104 to be removably connected to the receptacle 102. In alternative embodiments, the cover 104 can be attached to the receptacle 102 by, for example, a hinged connection, and the cover 104 can be moved between an open position and a closed position relative to the receptacle 102. The cover 104 can have a drinking opening 106 that allows a user to access and drink the liquid that is disposed within the receptacle 102. In other embodiments, the cover 104 may not include a drinking opening, but a user can access the liquid by removing the cover 104 from the receptacle 102 or by moving the cover 104 to an open position relative to the receptacle 102.

In the illustrated embodiment, a locking element 108 is attached to the receptacle 102 and positioned to engage the cover 104 to lock the cover 104 to the receptacle 102. The locking element 108 can lock the cover 104 to the receptacle 102 in one or more positions. For example, the cover 104 can be locked to the receptacle 102 such that a user can access the liquid within the receptacle through the drinking opening 106. The cover 104 can be locked to the receptacle such that the drinking opening 106 is blocked from allowing liquid to move therethrough, which prevents a person other than the user from being able to access the liquid within the receptacle 102. The locking element 108 can also be moved to an unlocked position that allows a user to remove the cover 104 from the receptacle.

In certain implementations, the cover 104 has two or more components that are movable relative to each other such that these components can be moved to one or more positions in which the drinking opening 106 is not blocked and one or more positions in which the drinking opening 106 is blocked. For example, the cover 104 can include upper and lower portions (e.g., see the cover 404*a* shown in FIGS. 7-8) that are rotatable relative to each other. In other implementations, the cover 104 can include a body and a tab portion that is movable relative to the body (e.g., see the cover 404*b* shown in FIGS. 9-10). The cover 104 can, however, take any other suitable configuration that allows locking element 108 to lock the drinking opening 106 in a blocked and/or unblocked positions. In some implementations, the locking element 108 is configured to lock the cover 104 to the receptacle 102 when the drinking opening 106 is blocked, but not lock the cover 104 to the receptacle 102 when the drinking opening is not blocked.

The locking element 108 can be configured to lock the cover 104 in any of the positions mentioned above. For example, the cover 104 can have one or more locking receivers 112 for receiving the locking element 108 (e.g., a latch 110 of the locking element 108). The locking receiver(s) 112 can be included on any portion or component of the cover 104 that allows the cover 104 to be locked in a desired position. While the illustrated implementation shows the cover 104 having a single locking receiver 112, it should be understood that the cover 104 can have more than one locking receiver for receiving the locking element 108. The locking receiver(s) 112 can be, for example, an opening or channel configured to receive the locking element 108 and maintain the locking element in a locked position relative to the locking receiver 112 until a user moves the locking element 108 to an unlocked position.

The locking element 108 can be mechanical lock (e.g., a combination lock, a keyed-lock, etc.) or an electro-mechanical lock (e.g., a combination lock, a fingerprint lock, facial recognition lock, etc.). In certain embodiments, the locking element 108 may be an electromechanical lock that uses a solenoid to move the lock element 108 between a locking position and an unlocked position. In embodiments in which the locking element 108 is an electro-mechanical device, the drinking device 100 can include a power source (e.g., a battery) for powering the locking element 108 to move the locking element between locking positions and unlocked positions.

The locking element 108 can include a latch 110 and an engagement portion 114 for engagement by the user to move the latch 110 between extended and shortened positions. In some embodiments, the engagement portion 114 includes a combination portion that allows a user to enter a lock combination (e.g., a three-digit code, a four-digit code, etc.) to move the latch 110 between the extended and shortened positions. In other embodiments, the engagement portion 114 may include a fingerprint scanner, a facial recognition scanner, or any other type of component that allows a user to engage the engagement portion 114 to move the latch 110 between the extended and shortened positions. In yet other embodiments, the locking element 108 does not include an engagement portion, but the latch 110 is movable between the extended and shortened positions via a connection with a separate electronic device (e.g., a cellular phone, a tablet, a watch, etc.).

In various embodiments, the locking element 108 is a mechanical lock that includes a lock control element 116 for moving the latch 110 between the extended and shortened positions. For example, after a user engages the engagement portion 114 and enters the lock combination (or other means of unlocking the locking element 108), the user may engage the lock control element 116 to move the latch 110 between the extended and shortened positions. The lock control element 116 can be, for example, a push button, a rotatable dial, a key, or any other suitable component that can be engaged to move the latch 110 between the extended and shortened positions. In some embodiments, the latch 110 is normally in the extended position (e.g., the latch may be spring-loaded), and engagement of the lock control element 116 causes the latch 110 to move to the shortened position.

In some embodiments, the locking element 108 is an electro-mechanical lock that causes the latch 110 to automatically move between the extended and shortened positions. For example, the user may engage an electronic lock combination, fingerprint scanner, facial recognition scanner, or other form of electronic engagement to move the latch 110 between the extended and shortened positions. In other embodiments, the locking element 108 does not include an engagement portion, but the locking element 108 is electronically connected to another electronic device (e.g., a cellular phone, a tablet, a watch, etc.) such that a user can move the locking element 108 between extended and shortened positions by engaging the electronic device to which the locking element 108 is connected to. For example, a user can enter a lock combination, enter a fingerprint scan or a facial recognition scan, and/or engage a button on the electronic device to move the locking element 108 between extended and shortened positions. The locking element 108 can be connected to the electronic device by any suitable type of connection that allows the electronic device to be engaged to control the locking element 108, such as, for example, via a Bluetooth connection. In some implementations, the latch 110 is normally in the extended position (e.g., the latch may be spring-loaded), and the electronic engagement of the locking element 108 causes the latch 110 to move to the shortened position.

Figure 2:
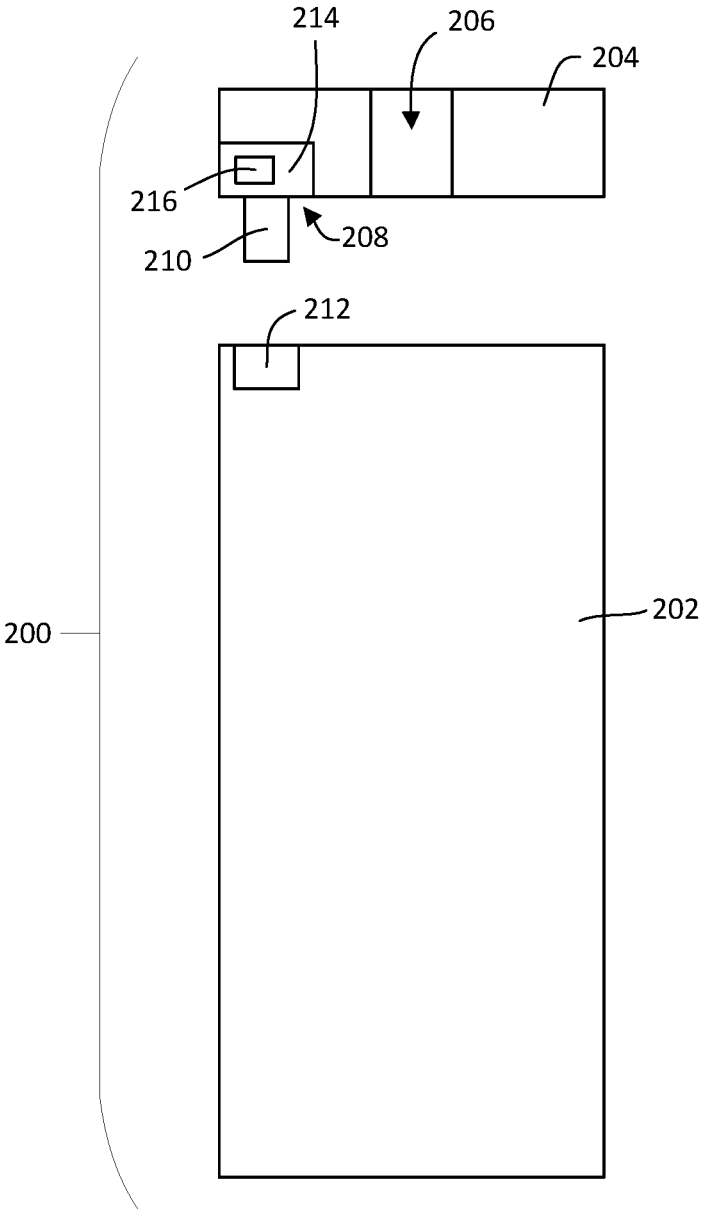
FIG. 2 is an exploded schematic view of another exemplary embodiment of a drinking device having a locking element.

Referring to FIG. 2, another exemplary embodiment of a drinking device 200 includes a receptacle 202 and a cover 204. The receptacle 202 is configured to hold a liquid, and the cover 204 is configured to be removably attached to the receptacle 202 to encapsulate the liquid within the receptacle 202. The cover 204 can be removably attached to the receptacle 202, for example, by a threaded connection, a snap-fit connection, a friction fit connection, or any other suitable type of connection allows the cover 204 to be removably connected to the receptacle 202. In alternative embodiments, the cover 204 can be attached to the receptacle 202 by, for example, a hinged connection, and the cover 204 can be moved between an open position and a closed position relative to the receptacle 202. The cover 204 can have a drinking opening 206 that allows a user to access and drink the liquid that is disposed within the receptacle 202. In other embodiments, the cover 104 may not include a drinking opening, but a user can access the liquid by removing the cover 104 from the receptacle 102 or by moving the cover 104 to an open position relative to the receptacle 102.

In the illustrated embodiment, a locking element 208 is attached to the cover 204 and positioned to engage the receptacle 202 to lock the cover 204 to the receptacle 202. The locking element 208 can lock the cover 204 to the receptacle 202 in one or more positions. For example, the cover 204 can be locked to the receptacle 202 such that a user can access the liquid within the receptacle through the drinking opening 206. The cover 204 can be locked to the receptacle such that the drinking opening 206 is blocked from allowing liquid to move therethrough, which prevents a person other than the user from being able to access the liquid within the receptacle 202. The locking element 208 can also be moved to an unlocked position that allows a user to remove the cover 204 from the receptacle.

In certain implementations, the cover 204 has two or more components that are movable relative to each other such that these components can be moved to one or more positions in which the drinking opening 206 is not blocked and one or more positions in which the drinking opening 206 is blocked. For example, the cover 204 can include upper and lower portions (e.g., see the cover 404*a* shown in FIGS. 7-8) that are rotatable relative to each other. In other implementations, the cover 204 can include a body and a tab portion that is movable relative to the body (e.g., see the cover 404*b* shown in FIGS. 9-10). The cover 204 can, however, take any other suitable configuration that allows locking element 208 to lock the drinking opening 206 in a blocked and/or unblocked positions. In some implementations, the locking element 208 is configured to lock the cover 204 to the receptacle 202 when the drinking opening 206 is blocked, but not lock the cover 204 to the receptacle 202 when the drinking opening is not blocked.

The locking element 208 can be configured to lock the cover 204 to the receptacle 202 while the cover 204 is locked in any of the positions mentioned above. For example, the receptacle 202 can have one or more locking receivers 212 for receiving the locking element 208 (e.g., a latch 210 of the locking element 208). The locking receiver(s) 212 can be included on any portion or component of the receptacle 202 that allows the cover 204 to be locked in a desired position. The cover 204 can include one or more openings that align with the locking receiver(s) 212 that allow the cover 204 to be locked in various positions (e.g., positions in which the drinking opening 206 is blocked and not blocked). While the illustrated implementation shows the receptacle 202 having a single locking receiver 212, it should be understood that the receiver 202 can have more than one locking receiver for receiving the locking element 208. The locking receiver(s) 212 can be, for example, an opening or channel configured to receive the locking element 208 and maintain the locking element in a locked position relative to the locking receiver 212 until a user moves the locking element 208 to an unlocked position.

In alternative embodiments, one or more locking receiver(s) may be disposed on the cover 204 in addition to or instead of the locking receiver(s) 212 disposed on the receptacle. In these embodiments, the locking element 208 can be configured to lock components of the cover 204 in a desired position relative to each other with or without locking the cover 204 to the receptacle 202. This will allow a user to lock the cover 204 in a position in which the drinking opening 206 is blocked without also having the cover 204 locked to the cover 202.

The locking element 208 can be mechanical lock (e.g., a combination lock, a keyed-lock, etc.) or an electro-mechanical lock (e.g., a combination lock, a fingerprint lock, facial recognition lock, etc.). In certain embodiments, the locking element 208 may be an electromechanical lock that uses a solenoid to move the lock element 208 between a locking position and an unlocked position. In embodiments in which the locking element 208 is an electro-mechanical device, the drinking device 200 can include a power source (e.g., a battery) for powering the locking element 208 to move the locking element between locking positions and unlocked positions.

The locking element 208 can include a latch 210 and an engagement portion 214 for engagement by the user to move the latch 210 between extended and shortened positions. In some embodiments, the engagement portion 214 includes a combination portion that allows a user to enter a lock combination (e.g., a three-digit code, a four-digit code, etc.) to move the latch 210 between the extended and shortened positions. In other embodiments, the engagement portion 214 may include a fingerprint scanner, a facial recognition scanner, or any other type of component that allows a user to engage the engagement portion 214 to move the latch 210 between the extended and shortened positions. In yet other embodiments, the locking element 208 does not include an engagement portion, but the latch 210 is movable between the extended and shortened positions via a connection with a separate electronic device (e.g., a cellular phone, a tablet, a watch, etc.).

In various embodiments, the locking element 208 is a mechanical lock that includes a lock control element 216 for moving the latch 210 between the extended and shortened positions. For example, after a user engages the engagement portion 214 and enters the lock combination (or other means of unlocking the locking element 208), the user may engage the lock control element 216 to move the latch 210 between the extended and shortened positions. The lock control element 216 can be, for example, a push button, a rotatable dial, a key, or any other suitable component that can be engaged to move the latch 210 between the extended and shortened positions. In some embodiments, the latch 210 is normally in the extended position (e.g., the latch may be spring-loaded), and engagement of the lock control element 216 causes the latch 210 to move to the shortened position.

In some embodiments, the locking element 208 is an electro-mechanical lock that causes the latch 210 to automatically move between the extended and shortened positions. For example, the user may engage an electronic lock combination, fingerprint scanner, facial recognition scanner, or other form of electronic engagement to move the latch 210 between the extended and shortened positions. In other embodiments, the locking element 208 does not include an engagement portion, but the locking element 208 is electronically connected to another electronic device (e.g., a cellular phone, a tablet, a watch, etc.) such that a user can move the locking element 208 between extended and shortened positions by engaging the electronic device to which the locking element 208 is connected to. For example, a user can enter a lock combination, enter a fingerprint scan or a facial recognition scan, and/or engage a button on the electronic device to move the locking element 208 between extended and shortened positions. The locking element 208 can be connected to the electronic device by any suitable type of connection that allows the electronic device to be engaged to control the locking element 208, such as, for example, via a Bluetooth connection. In some implementations, the latch 210 is normally in the extended position (e.g., the latch may be spring-loaded), and the electronic engagement of the locking element 208 causes the latch 210 to move to the shortened position.

Figure 3:
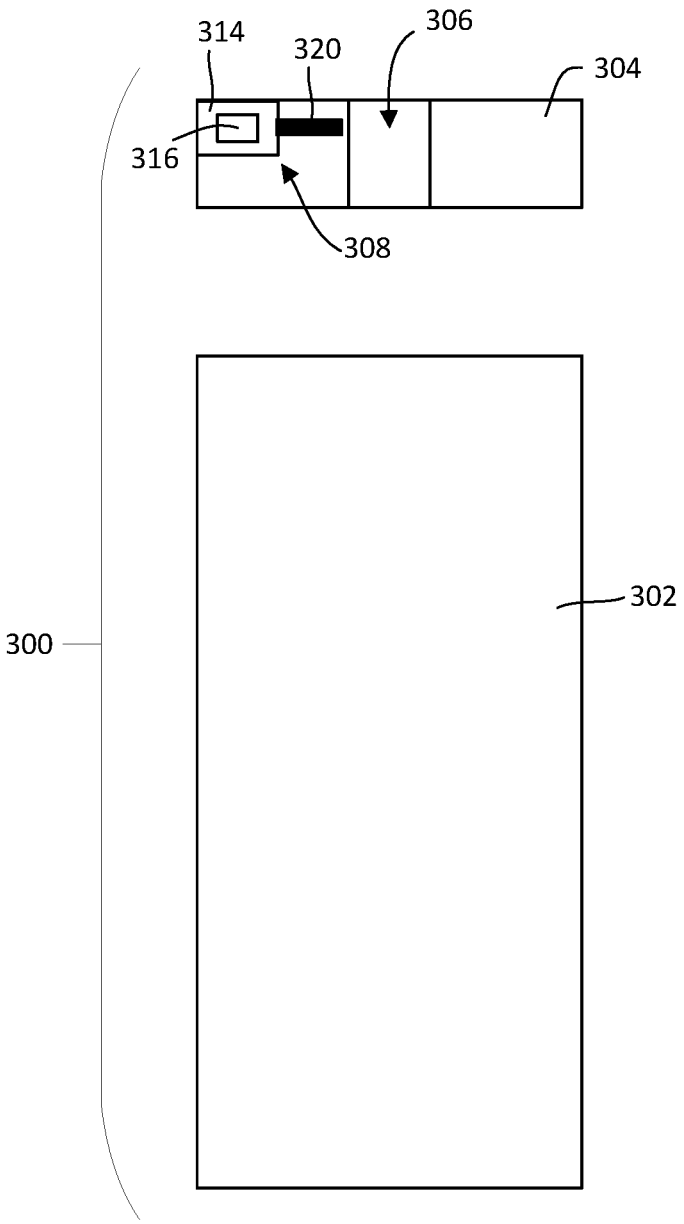
FIG. 3 is an exploded schematic view of another exemplary embodiment of a drinking device having a locking element, where the locking element is positioned to allow liquid to move through a drinking opening of a cover.
Figure 4:
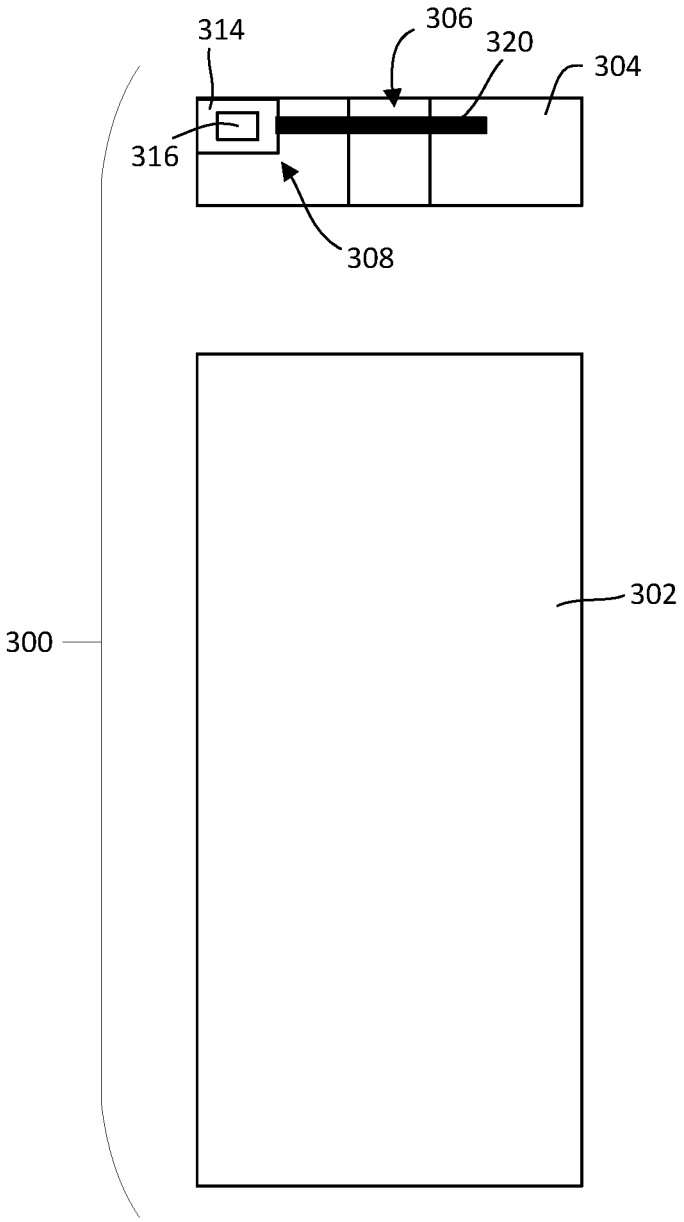
FIG. 4 is an exploded schematic view of the drinking device of FIG. 3, where the locking element is positioned to prevent liquid from moving through the drinking opening of the cover.
Figure 5:
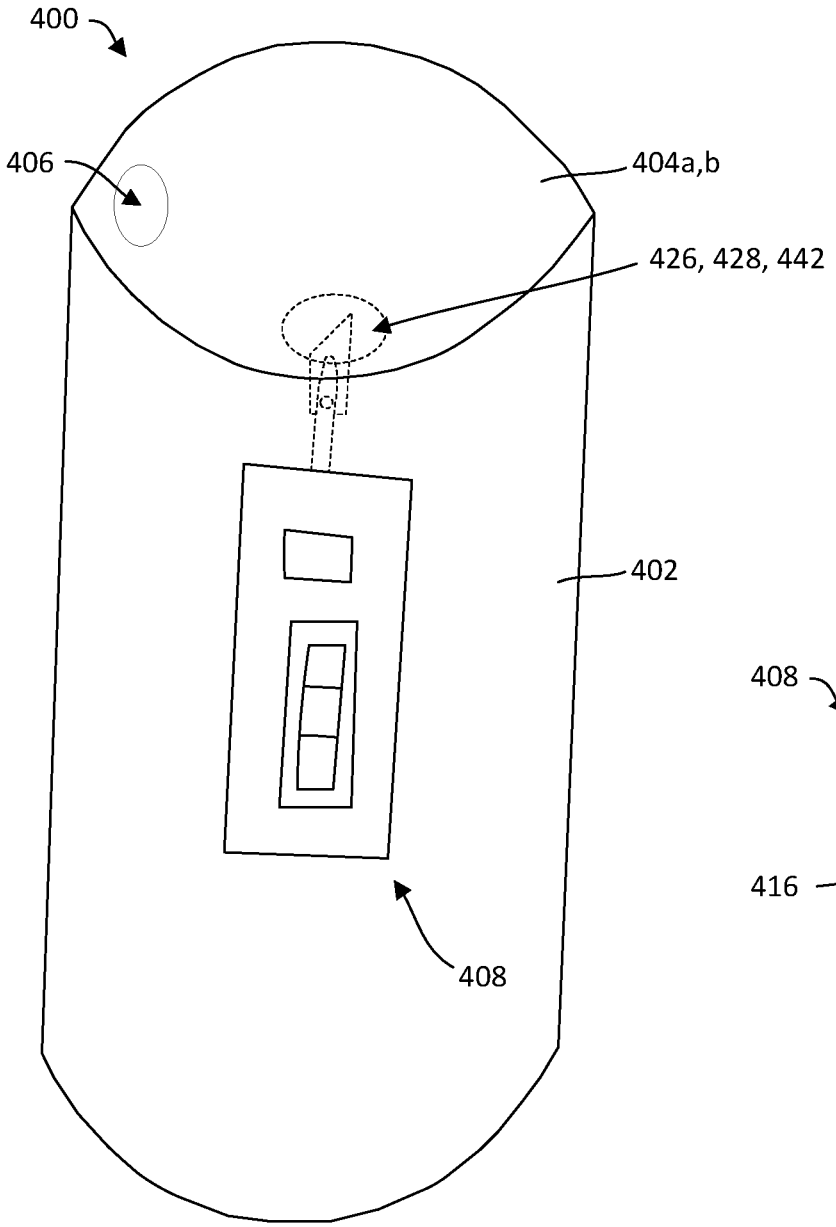
FIG. 5 is a perspective view of another exemplary embodiment of a drinking device having an exemplary locking element.

Referring to FIGS. 3 and 4, another exemplary embodiment of a drinking device 300 includes a receptacle 302 and a cover 304. The receptacle 302 is configured to hold a liquid, and the cover 304 is configured to be removably attached to the receptacle 302 to encapsulate the liquid within the receptacle 302. The cover 304 can be removably attached to the receptacle 302, for example, by a threaded connection, a snap-fit connection, a friction fit connection, or any other suitable type of connection allows the cover 304 to be removably connected to the receptacle 302. In alternative embodiments, the cover 304 can be attached to the receptacle 302 by, for example, a hinged connection, and the cover 304 can be moved between an open position and a closed position relative to the receptacle 302. The cover 304 can have a drinking opening 306 that allows a user to access and drink the liquid that is disposed within the receptacle 302. The cover 304 can take any suitable form, such as, for example, any form described in the present application.

In the illustrated embodiment, a locking element 308 is attached to the cover 304 and positioned to block the drinking opening 306. The locking element 308 can include a tab portion 320 and an engagement portion 314 for engagement by a user to move the tab portion 320 between a shortened position (as shown in FIG. 3) and an extended position (as shown in FIG. 4). In some embodiments, the engagement portion 314 includes a combination portion that allows a user to enter a lock combination (e.g., a three-digit code, a four-digit code, etc.) to move the tab portion 320 between the extended and shortened positions. In other embodiments, the engagement portion 314 may include a fingerprint scanner, a facial recognition scanner, or any other type of component that allows a user to engage the engagement portion 314 to move the tab portion 320 between the extended and shortened positions. In yet other embodiments, the locking element 308 does not include an engagement portion, but the tab portion 320 is movable between the extended and shortened positions via a connection with a separate electronic device (e.g., a cellular phone, a tablet, a watch, etc.).

The tab portion 320 of the locking element 308 can be sized to cover an entirety of the drinking opening 306 when the tab portion 320 is in the extended positions. The tab portion 320 can be configured to lock to a component of the cover 304 when the tab portion is in the extended position. For example, the cover 304 can include a locking receiver (e.g., any locking receiver described in the present application) for receiving the tab portion 320.

The locking element 308 can be mechanical lock (e.g., a combination lock, keyed-lock etc.) or an electro-mechanical lock (e.g., a combination lock, a fingerprint lock, facial recognition lock, etc.). In certain embodiments, the locking element 308 may be an electromechanical lock that uses a solenoid to move the lock element 308 between a locking position and an unlocked position. In embodiments in which the locking element 308 is an electro-mechanical device, the drinking device 300 can include a power source (e.g., a battery) for powering the locking element 308 to move the locking element between locking positions and unlocked positions.

In various embodiments, the locking element 308 is a mechanical lock that includes a lock control element 316 for moving the tab portion 320 between the extended and shortened positions. For example, after a user engages the engagement portion 314 and enters the lock combination (or other means of unlocking the locking element 308), the user may engage the lock control element 316 to move the tab portion between the extended and shortened positions. The lock control element 316 can be, for example, a push button, a rotatable dial, a key, or any other suitable component that can be engaged to move the latch 310 between the extended and shortened positions. In some embodiments, the tab portion 320 may be normally in one of the shortened or extended positions (e.g., the latch may be spring-loaded), and engagement of the lock control element 316 causes the tab portion 320 to move to the other position.

In some embodiments, the locking element 308 is an electro-mechanical lock that causes the tab portion 320 to automatically move between the extended and shortened positions. For example, the user may engage an electronic lock combination, fingerprint scanner, facial recognition scanner, or other form of electronic engagement to move the tab portion 320 between the extended and shortened positions. In other embodiments, the locking element 308 does not include an engagement portion, but the locking element 308 is electronically connected to another electronic device (e.g., a cellular phone, a tablet, a watch, etc.) such that a user can move the locking element 308 between extended and shortened positions by engaging the electronic device to which the locking element 308 is connected to. For example, a user can enter a lock combination, enter a fingerprint scan or a facial recognition scan, and/or engage a button on the electronic device to move the locking element 308 between extended and shortened positions. The locking element 308 can be connected to the electronic device by any suitable type of connection that allows the electronic device to be engaged to control the locking element 308, such as, for example, via a Bluetooth connection. In some implementations, the tab portion 320 may be normally in one of the shortened or extended positions (e.g., the latch may be spring-loaded), and engagement of the lock control element 316 causes the tab portion 320 to move to the other position.

Referring to FIGS. 5-10, another exemplary embodiment of a drinking device 400 includes a receptacle 402 and a cover 404*a,b*. The receptacle 402 is configured to hold a liquid, and the cover 404*a,b* is configured to be removably attached to the receptacle 402 to encapsulate the liquid within the receptacle 402. The cover 404*a,b* can be removably attached to the receptacle 402, for example, by a threaded connection, a snap-fit connection, a friction fit connection, or any other suitable type of connection allows the cover 404*a,b* to be removably connected to the receptacle 402. The cover 404*a,b* can have a drinking opening 406 that allows a user to access and drink the liquid that is disposed within the receptacle 402.

In the illustrated embodiment, a locking element 408 is attached to the receptacle 402 and positioned to engage the cover 404*a,b* to lock the cover 404*a,b* to the receptacle 402. The locking element 408 can lock the cover 404*a,b* to the receptacle 402 in one or more positions. For example, the cover 404*a,b* can be locked to the receptacle 402 such that a user can access the liquid within the receptacle through the drinking opening 406. The cover 404 can be locked to the receptacle such that the drinking opening 406 is blocked from allowing liquid to move therethrough, which prevents a person other than the user from being able to access the liquid within the receptacle 402. The locking element 408 can engage one or more locking receivers 426, 428. 442 to secure the cover 404*a,b* to the receptacle 402. The locking element 408 can also be moved to an unlocked position that allows a user to remove the cover 404 from the receptacle.

Figure 7:
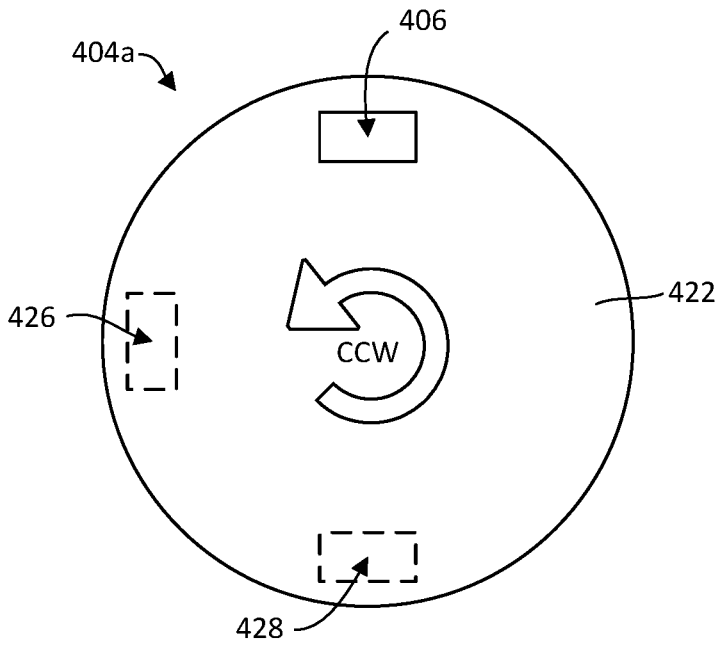
FIGS. 7-8 are top views of upper and lower portions, respectively, of an exemplary embodiment of a cover for the drinking device of FIG. 5.
Figure 8:
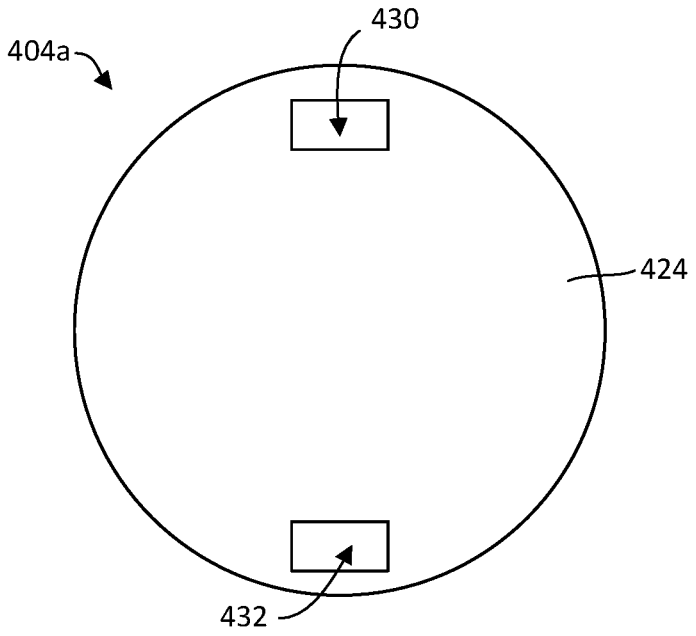

Referring to FIGS. 7 and 8, one exemplary embodiment of a cover 404*a* for the device 400 includes an upper portion 422 (FIG. 7) and a lower portion 424 (FIG. 8) that are rotatable relative to each other. Referring to FIG. 7, the upper portion 422 can have the drinking opening 406 that extends through the upper portion 406, as well as a first locking receiver 426 and a second locking receiver 428 that are disposed within a bottom surface of the upper portion 422. In other embodiments, the locking receivers 426, 428 may extend through the upper portion 422. Referring to FIG. 8, the lower portion 424 may have a lower drinking opening 430 and a lower locking opening 432, wherein the locking opening 432 aligns with the locking element 408 that is attached to the receptacle 402.

Referring to FIGS. 7 and 8, the lower drinking opening 430 aligns with the drinking opening 406 when the upper and lower portions 422, 424 are in the shown positions, which allows a user to access the liquid within the receptacle 402. When in this position, the locking receiver 428 of the upper portion 422 aligns with the locking opening 432 of the lower portion 424 such that the locking element 408 can lock the upper and lower portions relative to each other, as well as lock the cover 402 to the receptacle. Rotation of the upper portion 422 in a counterclockwise direction CCW relative to the lower portion 424 allows a user to move the drinking opening 406 away from the lower drinking opening 430 such that drinking opening 406 is blocked and liquid within the receptacle 402 is prevented from moving through the drinking opening 406. Continued movement of the upper portion 422 in the counterclockwise direction CCW relative to the lower portion 424 allows a user to align the locking receiver 426 of the upper portion 422 with the locking opening 432 of the lower portion 424, which allows the locking element to extend through the locking opening 432 to engage the locking receiver 426 and lock the cover 404*a* in a position in which the drinking opening 406 is blocked and liquid is prevented from moving through the drinking opening 406. When the locking element 408 is not engaged with either of the locking receivers 426, 428, the locking element 408 may be in an unlocked position and the cover 404*a* can be removed from the receptacle 402. While the upper portion 422 is shown being rotatable in the counterclockwise direction CCW relative to the lower portion 424, it should be understood that the upper portion 422 be rotatable in the both the counterclockwise and clockwise directions, only the counterclockwise direction, or only the clockwise direction.

Figure 9:
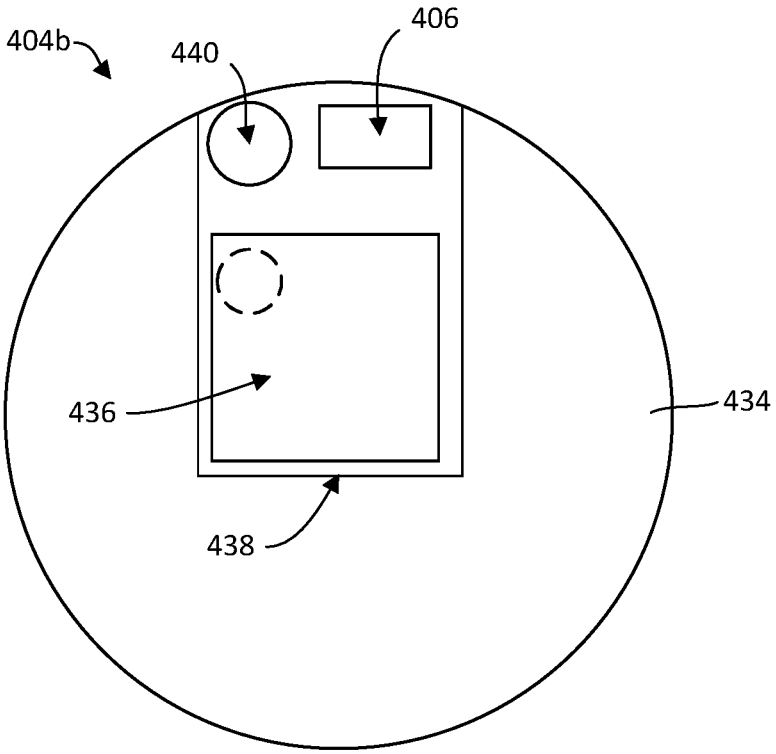
FIG. 9 is a top view of another exemplary embodiment of a cover for the drinking device of FIG. 4, where a tab portion of the cover is shown in a position that allows liquid to move through a drinking opening.
Figure 10:
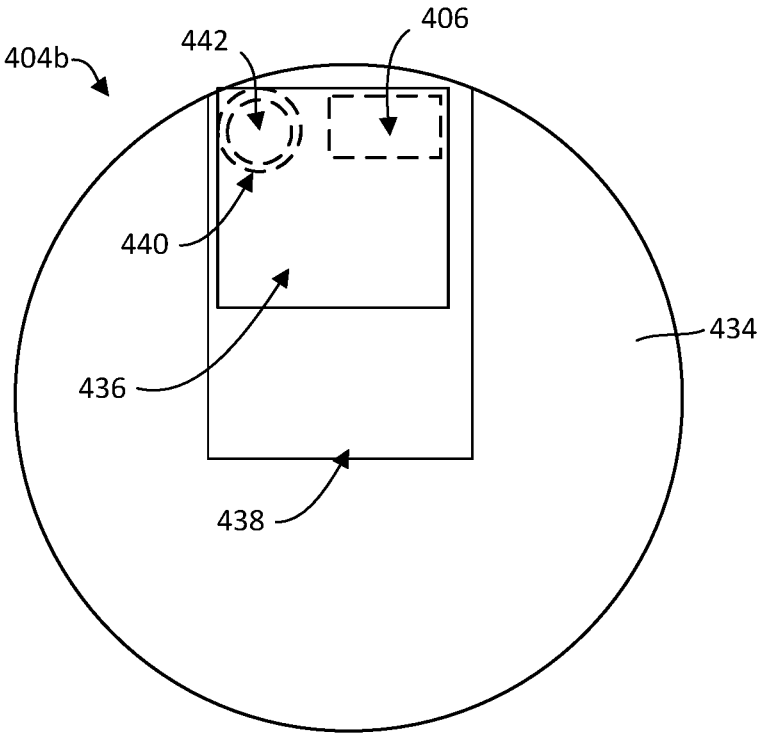
FIG. 10 is a top view of the cover of FIG. 9, where a tab portion of the cover is shown in a position that prevents liquid from moving through the drinking opening.

Referring to FIGS. 9 and 10, another exemplary embodiment of a cover 404*b* for the device 400 includes a body 434 and a tab portion 436 that is movable relative to the body 434. The body 434 includes the drinking opening 406 such that the user can access the liquid within the receptacle 402. The body 424 also includes a locking opening 440 that aligns with the locking element 408 that is attached to the receptacle 402. The tab portion 436 includes a locking receiver 442 for receiving the locking element 408.

The tab portion 436 can be movable between a first position (as shown in FIG. 9) and a second position (as shown in FIG. 10) relative to the body 434. In certain embodiments, the tab portion 436 can be slidably coupled to the body 434, such as, for example, by a tongue and groove connection, a roller connection, or any other suitable type of connection. In some embodiments, the body 434 can include a channel 438 in which the tab portion 436 is disposed. Referring to FIG. 9, when the tab portion 436 is in the first position the drinking opening 406 is not blocked by the tab portion 436, which allows a user to access the liquid within the receptacle 402. Referring to FIG. 10, when the tab portion 436 is in the second position, the tab portion 436 blocks the drinking opening 406 and prevents liquid from moving through the drinking opening 406. When in the second position, the locking receiver 442 tab portion 436 aligns with the locking opening 440 of the body 434 such that the locking element 408 can engage the locking receiver 442 and lock the cover 404*b* in a position in which the drinking opening 406 is blocked, as well as lock the cover 404*b* to the receptacle 402. When the locking element 408 is not engaged with the locking receiver 442, the locking element 408 may be in an unlocked position and the cover 404*a* can be removed from the receptacle 402.

While the illustrated implementations show the cover 404*a* having two locking receivers 426, 428 and the cover 404*b* having a single locking receiver 442, it should be understood that the covers 404*a,b* can have any suitable number of locking receivers. The locking receiver(s) can be, for example, an opening or channel configured to receive the locking element 408 and maintain the locking element in a locked position relative to the locking receiver until a user moves the locking element 408 to an unlocked position.

Figure 6:
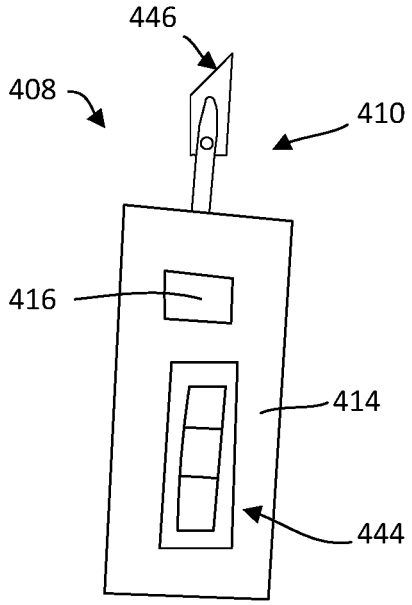
FIG. 6 is a front view of the locking element for the drinking device of FIG. 5.

Referring to FIG. 6, the locking element 408 can be mechanical, combination lock. The locking element 408 can include a latch 410 and an engagement portion 414 for engagement by the user to move the latch 410 between extended and shortened positions. In some embodiments, the engagement portion 414 includes a combination portion 444 that allows a user to enter a lock combination (e.g., a three-digit code, a four-digit code, etc.) to move the latch 410 between the extended and shortened positions. The locking element 408 may further include a lock control element 416 for moving the latch 410 between the extended and shortened positions. In the illustrated embodiment, the lock control element 416 comprises a push button. However, the lock control element 416 can take any other suitable form, such as, for example, any form described in the present application. After a user engages the engagement portion 114 and enters the lock combination into the combination portion 414, the user may engage the lock control element 116 to move the latch 410 between the extended and shortened positions. In some embodiments, the latch 410 is normally in the extended position (e.g., the latch may be spring-loaded), and engagement of the lock control element 416 causes the latch 410 to move to the shortened position. The latch 410 may include a beveled portion 446 that facilitates connection between the locking element 408 and the one or more locking receivers 426, 428, 442 of the device 400.

While the device 400 is shown having a mechanical, combination locking element 408, it should be understood that any suitable mechanical or electro-mechanical locking element can be used with the device 400, such as, for example, any mechanical or electro-mechanical locking element described in the present application.

While the various embodiments described in the present application refer to a drinking device, it should be understood that the present application also refers to food carrying device having similar concepts. For example, an example food carrying device can include a receptacle, a cover, and a locking element that is configured to lock the cover in a desired position relative to the receptacle. In some embodiments, the cover may include an eating opening, and the locking element may be configured to lock the cover in a position such that the eating opening is blocked such that another person cannot access the food through the eating opening unless the user unlocks the locking element. In other embodiments, the food carrying device may not include an eating opening, but a user can access the food by removing the cover from the receptacle or by moving the cover to an open position relative to the receptacle. The locking element can be a mechanical or electro-mechanical lock that is capable of being moved between locking positions and unlocked positions relative to the receptacle and/or the cover.

While various inventive aspects, concepts and features of the inventions may be described and illustrated herein as embodied in combination with exemplary embodiments, these various aspects, concepts and features may be used in many alternative embodiments, either individually or in various combinations and sub-combinations thereof. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein.

Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. A drinking device, comprising:

a receptacle for holding a liquid, the receptacle comprising a locking element that is moveable relative to the receptacle; and a cover removably attached to the receptacle to encapsulate the liquid within the receptacle, the cover comprising:

a drinking opening that allows a user to access the liquid within the receptacle;

a locking receiver for receiving the locking element of the receptacle;

a lower portion having a lower drinking opening and a lower locking opening; and an upper portion that is rotatable relative to the lower portion, the upper portion comprising the drinking opening and the locking receiver, wherein the locking receiver comprises a first locking receiver;

wherein the locking element of the receptacle is movable between:

an unlocked position that allows the cover to be removed from the receptacle;

a first locking position wherein the locking element engages the locking receiver to secure the cover to the receptacle, the locking element blocks the drinking opening to prohibit access to the liquid contained in the receptacle, the locking element is disposed within the first locking receiver, and the lower drinking opening of the lower portion is not aligned with the drinking opening of the upper portion; and a second locking position wherein the locking element engages the locking receiver to secure the cover to the receptacle and wherein the locking element does not block the drinking opening to allow access to the liquid contained in the receptacle.

2. The drinking device according to claim 1, wherein the locking receiver comprises a second locking receiver, wherein the locking element is in the second locking position when the locking element is disposed within the second locking receiver and wherein the lower drinking opening of the lower portion is aligned with the drinking opening of the upper portion when the locking element is in the second locking position.

3. The drinking device according to claim 1, wherein the locking element comprises a latch that is movable between an extended position and a shortened position.

4. The drinking device according to claim 3, wherein the latch is spring-loaded to the extended position.

5. The drinking device according to claim 1, wherein the locking element comprises a combination portion that allows a user to enter a lock combination such that a user can move the locking element between the first locking position, the second locking position, and the unlocked position.

6. The drinking device according to claim 5, wherein the locking element comprises a lock control member that is configured to be engaged by a user after the user enters the lock combination to move a latch of the locking element from the extended position to the shortened position.

7. The drinking device according to claim 6, wherein the lock control member comprises a push button.

8. The drinking device according to claim 6, wherein the lock control member comprises a rotatable dial.

9. The drinking device according to claim 1, wherein the locking element is an electro-mechanical locking element that includes a latch that is movable between an extended position and a shortened position.

10. The drinking device according to claim 9, wherein the locking element comprises a fingerprint portion that allows a user to move the latch between the extended position and shortened position by placing a finger of the user on the fingerprint portion.

11. The drinking device according to claim 9, wherein the locking element comprises a combination portion that allows a user to enter a lock combination to move the latch between the extended position and the shortened position.

12. A drinking device, comprising:

a receptacle for holding a liquid, the receptacle comprising a locking element that is moveable relative to the receptacle;

a cover removably attached to the receptacle to encapsulate the liquid within the receptacle, the cover comprising:

a lower portion having a lower drinking opening and a lower locking opening; and an upper portion that is rotatable relative to the lower portion, the upper portion having an upper drinking opening that allows a user to access the liquid within the receptacle, a first locking receiver, and a second locking receiver, wherein the first locking receiver and the second locking receiver are for receiving the locking element of the receptacle; and wherein the locking element comprises a combination portion, and wherein upon entry of a lock combination in the combination portion the locking element is movable relative to the cover and to the receptacle between:

an unlocked position that allows the cover to be removed from the receptacle;

a first locking position wherein the locking element extends through the lower locking opening of the lower portion of the cover and is secured within the first locking receiver of the upper portion of the cover, and wherein the lower drinking opening is not aligned with the upper drinking opening to prohibit access to the liquid contained in the receptacle; and a second locking position wherein the locking element extends through the lower locking opening of the lower portion of the cover and is secured within the second locking receiver of the upper portion of the cover, and wherein the lower drinking opening is aligned with the upper drinking opening to allow access to the liquid contained in the receptacle.

13. The drinking device according to claim 12, wherein the locking element comprises a latch for extending into the first locking receiver and the second locking receiver of the upper portion of the cover to secure the locking element in at least one of the first locking position and the second locking position and a lock control member that is configured to be engaged by a user after the user enters the lock combination to move the latch from the extended position to the shortened position such that the locking element is in the unlocked position.

14. The drinking device according to claim 13, wherein the latch is spring-loaded to the extended position.

15. The drinking device according to claim 12, wherein the locking element is an electro-mechanical locking element that includes a latch that is movable between an extended position and a shortened position.

* * * * *